US006243975B1

(12) United States Patent
Gall

(10) Patent No.: US 6,243,975 B1
(45) Date of Patent: Jun. 12, 2001

(54) BLADE ATTACHMENT FOR EXCAVATOR BUCKET

(76) Inventor: Jeffrey Gall, 1951 Hwy. K, Hartford, WI (US) 53027

( * ) Notice: Subject to any disclaimer, the term of this patent is extended or adjusted under 35 U.S.C. 154(b) by 0 days.

(21) Appl. No.: 09/315,184

(22) Filed: May 20, 1999

(51) Int. Cl.[7] ..... E02F 3/76
(52) U.S. Cl. ..... 37/407; 37/446
(58) Field of Search ..... 37/403, 407, 408, 37/409, 410, 446, 903; 414/912

(56) References Cited

U.S. PATENT DOCUMENTS

| | | | | |
|---|---|---|---|---|
| 2,986,826 | * | 6/1961 | Timmons | 37/117.5 |
| 3,478,449 | | 11/1969 | Baker . | |
| 3,523,380 | | 8/1970 | Bolyard et al. . | |
| 3,866,342 | * | 2/1975 | Cooper | 37/117.5 |
| 4,009,529 | | 3/1977 | Johnson . | |
| 4,550,512 | | 11/1985 | Felstet . | |
| 4,769,933 | * | 9/1988 | Dejana | 37/231 |
| 4,813,164 | * | 3/1989 | Morrell | 37/117.5 |
| 4,936,392 | * | 6/1990 | Kitchin | 172/815 |
| 5,241,763 | * | 9/1993 | Dynan | 37/407 |
| 5,253,449 | * | 10/1993 | Webb et al. | 37/446 |
| 5,297,351 | | 3/1994 | Cote . | |
| 5,794,370 | * | 8/1998 | Haagenstad et al. | 37/404 |
| 5,918,389 | * | 7/1999 | Hall | 37/407 |
| 6,070,345 | * | 6/2000 | Akaki et al. | 37/407 |
| 6,088,938 | * | 7/2000 | Logan | 37/468 |
| 6,088,939 | * | 7/2000 | Logan | 37/468 |
| 6,098,321 | * | 8/2000 | Logan | 37/409 |

* cited by examiner

*Primary Examiner*—Victor Batson
(74) *Attorney, Agent, or Firm*—Ryan Kromholz & Manion, S.C.

(57) ABSTRACT

A blade attachment is adapted to be mounted to an excavator bucket assembly, the attachment including an elongated blade having a width substantially greater than the width of said bucket. The blade is provided with a pair of mounting brackets affixed to its rear with at least two mounting holes being provided through each mounting bracket. The mounting brackets are spaced apart a distance sufficient for mounting on the opposite side walls of the bucket. The brackets may be adjustably affixed to the rear of the blade to accommodate buckets of differing widths.

12 Claims, 2 Drawing Sheets

21
26
20
18
28
14
16
22
17
13
10
24
11
12

21
26
16a
18
14a
28
22
20
40
40
13
17
40
10a
12
40
42
42
24

BLADE ATTACHMENT FOR EXCAVATOR BUCKET

The present invention relates to a blade attachment for a backhoe bucket. More particularly, the invention relates a grading blade which is attachable to the backhoe bucket.

BACKGROUND OF THE INVENTION

Previous proposals have been made for attaching grading blades to backhoe buckets. Such blades would be desirable because the backhoes are often used to excavate established lawns or other planted areas which need to be restored to their original condition after the excavation is complete. Typically such excavations are used in the installation of water or sewer pipes or wiring, etc. Since, in most cases, the backhoe is the only mechanized implement on the excavation site it has been necessary to do much of the grading and refilling of the trench by hand.

Previous suggestions such as the attachments shown in U.S. Pat. No. 4,009,529 or U.S. Pat. No. 4,550,512 have not gained commercial acceptance due to various shortcomings. For example, the blade of the former patent is limited in practical effect to the original width of the bucket due to inherit weaknesses in the system of mounting the blade on the bucket. The '512 patent, in contrast, shows a more sturdy mounting system. However the sockets shown in that patent for receiving the blade attachments remain fixed in place thereby unacceptably widening the profile of the backhoe bucket. Due to such widening the digging efficiency of the bucket is seriously impaired resulting in a lack of commercial acceptance.

In view of the shortcomings of the prior art, a need has continued to exist for improved blade attachments would enable a backhoe bucket to be used for refilling and grading of the trench created by the backhoe.

SUMMARY OF THE INVENTION

The present invention as is its principal object the provision of an improved blade attachment for use on existing backhoe buckets. An important aspect of the present invention is the provision of such a blade attachment which can be securely mounted to the backhoe bucket. A related aspect is that the digging efficiency and earth cutting profile of the bucket are not altered and thus the efficiency of the backhoe is not reduced. A related aspect of the invention is the provision of an improved system of mounting the attachment to the bucket that makes the blade attachment resistant to twisting or separation from the bucket during use.

A further advantage of the present invention is the ability to configure attachable blades suited to various commercially available types of backhoe buckets. Thus, a single blade attachment of this invention is adaptable to be mounted on various excavator buckets of differing widths.

Another important related advantage of the present invention is a mounting system which ensures easy attachment of the blade to the backhoe bucket but which provides an attachment of enhanced stability.

A further aspect of the invention is the provision of an attachment which may be configured to fit around the existing cutting or toothed edge of the backhoe bucket, thus enhancing the stability of the blade against separation of the attachment from the bucket. In accordance with a further embodiment of the invention the width of the mounting attachment brackets is adjustable using readily available tools, thereby enabling easy attachment of a particular blade attachment to backhoe buckets of varying widths. In accordance with this aspect of the invention the manufacturing costs of providing the attachment can be reduced while enhancing the ability of the customer to use the attachment on equipment made by more than one manufacturer or which otherwise varies in width.

Briefly, the invention provides a blade attachment adapted to be mounted to an excavator bucket assembly. The attachment includes an elongated blade having a width substantially greater than the width of the bucket. The blade is provided with a pair of mounting brackets affixed to its rear with at least two mounting holes being provided through each mounting bracket. The mounting brackets are spaced apart a distance sufficient for mounting on the opposite side walls of the bucket.

Various other objects and advantages of the invention will be apparent from the following detailed description, the claims and the accompanying drawings.

DETAILED DESCRIPTION OF THE INVENTION

Figure 1:
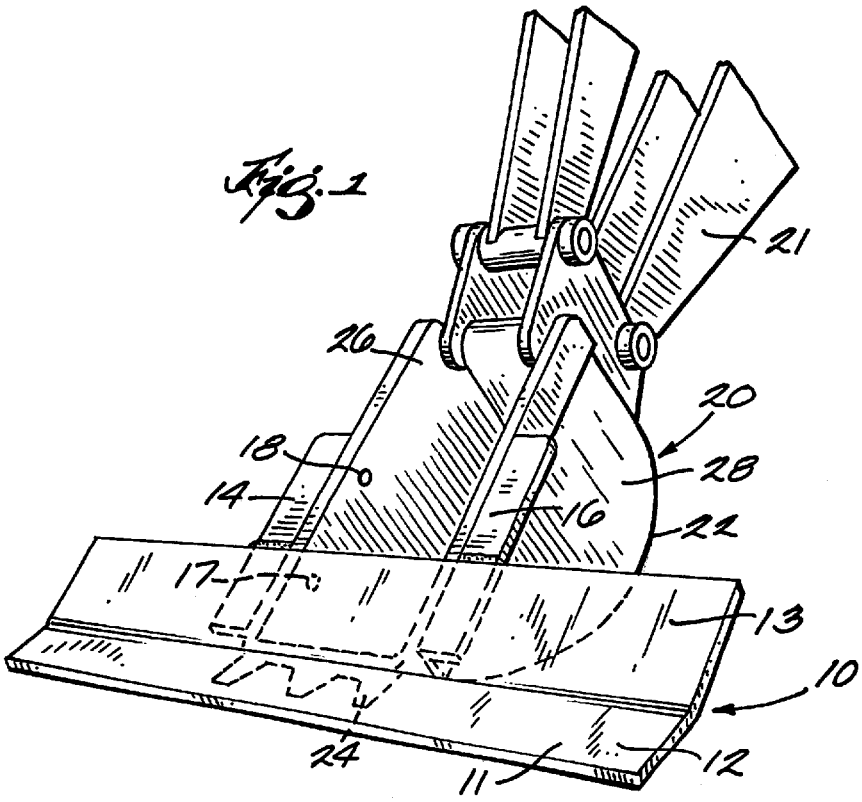
FIG. 1 is a perspective view of an attachment of this invention mounted on an excavator bucket with some hidden features shown by phantom lines.

Referring more specifically to the drawings, there is seen a blade attachment 10 of this invention. Attachment 10 includes a grading blade 11 to which a pair of mounting brackets 14 and 16 are integrally attached. Brackets 14 or 16 may be welded, bolted, or riveted to the blade 11. Brackets 14 and 16 are each provided with a pair of mounting holes 17 and 18. The brackets 14 and 16 are preferably formed of angle iron. Angle iron having a width of about 3 inches has been found suitable. Blade 11 is preferably formed of lower and upper sections 12 and 13. Sections 12 and 13 are angularity displaced by an amount adapted to conform to the front profile of backhoe bucket 20.

Mounting brackets 14 and 16 are spaced apart so that they fit closely on opposite sides 26 and 28 of excavator bucket 20. Bucket 20 has a generally C-shaped bucket structure 22 with a toothed forward lower cutting surface 24. It will be noted that the blade 11 has a substantially greater width (referring to the long dimension of the blade) than the width of bucket 20. Typically, a bucket 20 such that illustrated in the drawings will have a width of about 20 inches, whereas the blade 11 preferably provides a grading width of about 42 inches.

Figure 4:
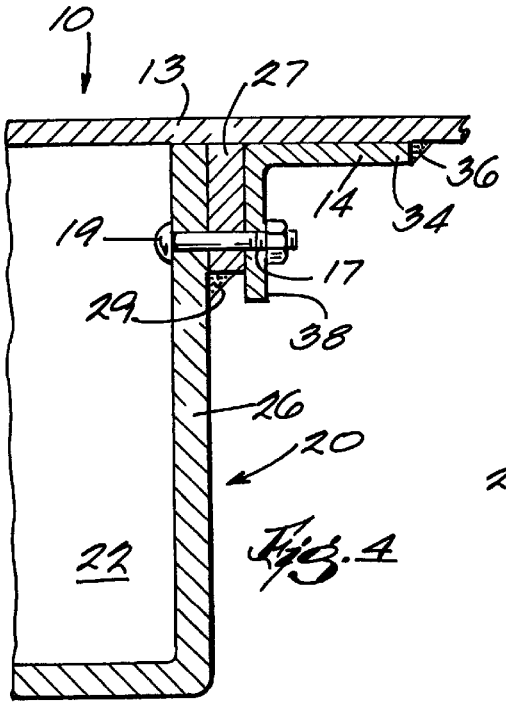
FIG. 4 is a fragmentary sectional view taken along line 4—4 of FIG. 3 illustrating the attachment shown in FIG. 1.
Figure 5:
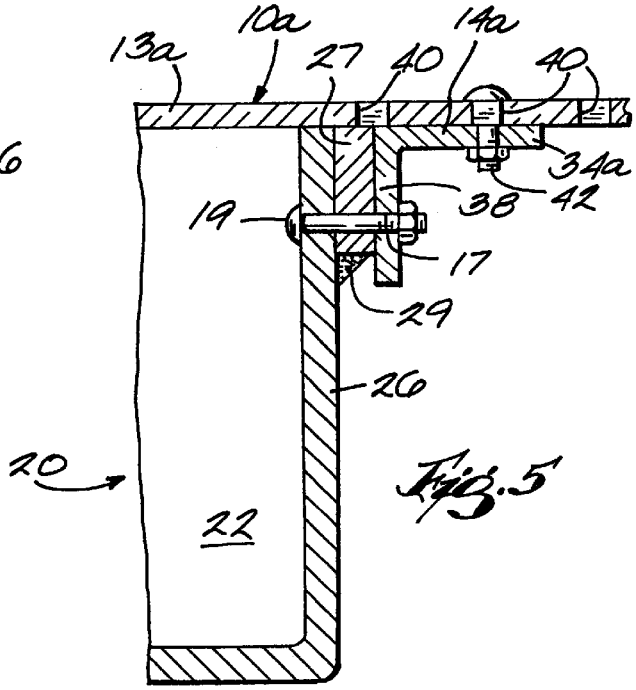
FIG. 5 is a fragmentary sectional view taken along line 4—4 of FIG. 3 illustrating the embodiment of FIG. 2.

An angle iron structure has been found ideal for mounting brackets 14 and 16 because of the ability to be mounted flat against the outer surfaces 26 and 28 of bucket 20 without the need of additional structure which would undesirably increase the width of the sidewalls 26 and 28. Typically, however, the upper edges of sidewalls 26 and 28 already may have reinforcing plates 27 welded to them as best seen in FIGS. 4 and 5. Additionally, the angle iron configuration of brackets 14 and 16 provides support behind the surface of blade section 13 and thereby provides resistance against twisting or bending of blade 11. However, it will be apparent to those skilled in the. art that other bracket configurations can be used. For example, brackets 14 and 16 could be formed of hollow tubes having a rectangular configuration, if desired.

Figure 3:
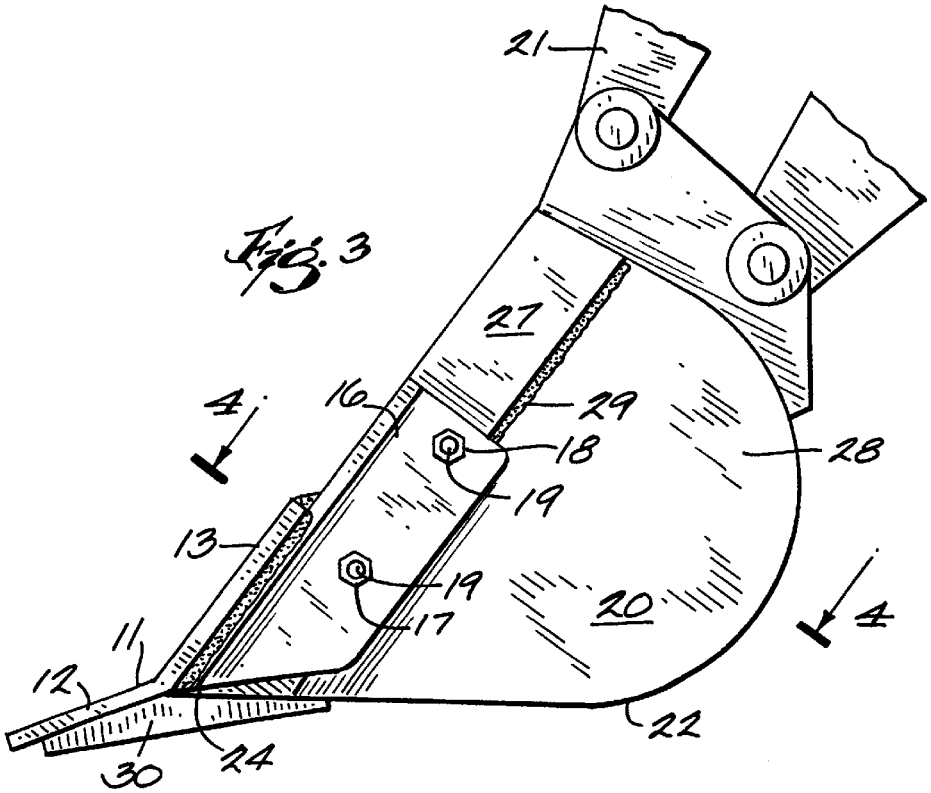
FIG. 3 is a side elevational view of an attachment of this invention mounted on an excavator bucket.

In FIG. 3 there is seen a preferred form of the attachment blade of this invention wherein a bottom plate 30 is affixed to the bottom of the lower segment 12 of blade 11. Bottom plate 30 is adapted to fit under the cutting teeth 24 at the lower forward edge of bucket 20. The presence of plate 30 assists in providing a secure mounting of the attachment 10 to the excavator bucket 20. In the various drawings numeral 21 indicates in general the working mechanism of the excavator arms which support bucket 20 on a tractor or excavating machine and do not form a part of the present invention.

Referring to FIG. 4 there is seen one preferred embodiment of the invention wherein an angle iron 14 is formed of one segment 34 which is secured by a weldment 36 to the rear surface of upper blade segment 13. The other angle iron segment 38 is provided with the holes 17 and 18, each of which are adapted to receive a bolt 19. Bolt 19 extends through aligned holes penetrating bucket side wall 26 and reinforcement 27. Reinforcement 27 is affixed to sidewall 26 by a weld 29. The spacing between sections 38 of angle irons 14 and 16 is such that these segments will lie in close contact with the outside of reinforcing members 27. In practice, when an attachment 10 is purchased by a customer for use on an existing excavator bucket, the attachment 10 will be positioned at the desired location on the bucket. Holes 17 and 18 are then drilled through the bucket sidewall 26 and reinforcement 27 using the holes 17 and 18 in the angle iron as a guides for accurately drilling said holes.

Figure 2:
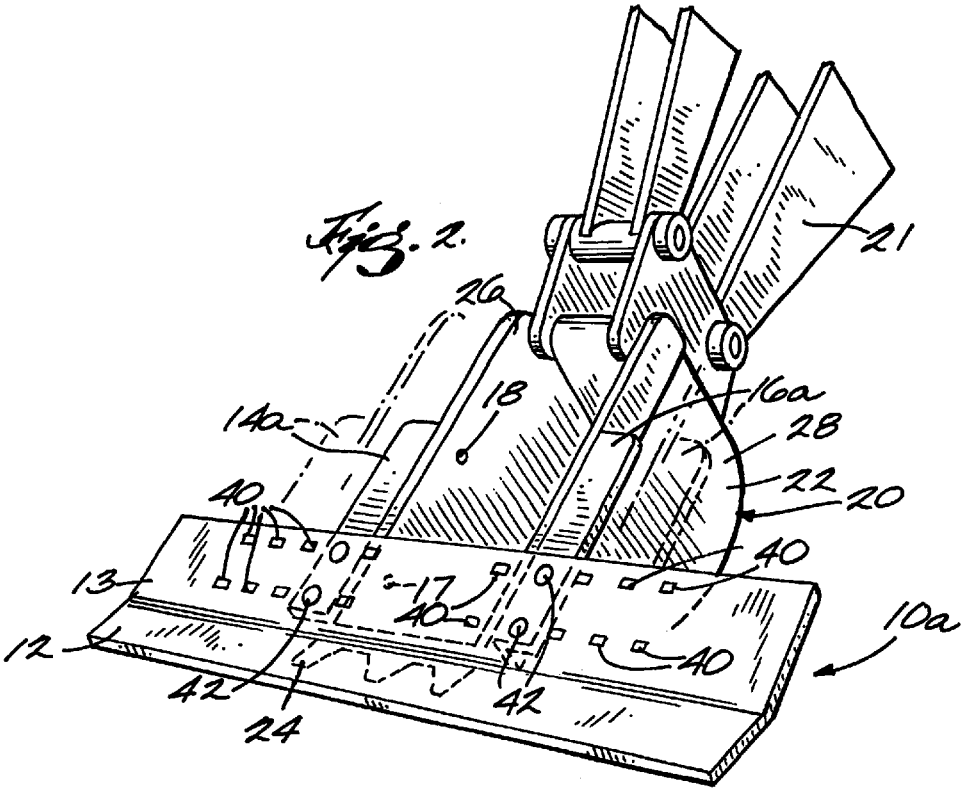
FIG. 2 is perspective view similar to FIG. 1 but showing an alternative embodiment of the invention and also illustrating mounting of the attachment on a bucket of a different width by means of phantom lines.

Referring to FIG. 2 there is seen an alternative attachment 10*a* in accordance with the invention. Attachment 10*a* is generally similar to attachment 10 with the distinction that the upper blade segment 13 is provided with a series of laterally displaced pairs of mounting holes 40 which enable the mounting of an attachment 10*a* on excavator buckets 20 of varying widths. A pair of bolts 32 is used to affix the brackets 14*a* and 14*b* at the desired location to enable mounting of the blade exteriorly of a bucket 20 of a specific as seen in FIG. 5. In other respects attachment 10*a* is substantially identical to the blade attachment 10.

It will be apparent to those skilled in the art that various modifications of the foregoing illustrative embodiment are possible. Thus, the invention also encompasses any and all embodiments within the scope of the following claims.

What is claimed is:

1. A blade attachment adapted to be mounted to an excavator bucket assembly having a generally C-shaped wall structure having a first width, with a pair of oppositely disposed sidewalls affixed thereto and having a forward lower edge adapted to penetrate the earth for excavation thereof, said attachment including an elongated blade having a forward surface adapted for grading and a rear surface, said blade having a width substantially greater than said first width; and a pair of mounting brackets affixed to the rear surface of said blade, at least two mounting holes through each of said mounting brackets adapted to be aligned with mounting holes provided in said sidewalls, said mounting brackets being spaced apart a distance equal to said first width for mounting said brackets directly on said opposite side walls.

2. An attachment according to claim 1 wherein said blade has a lower forward earth penetrating edge and includes a rearwardly extending lip affixed to said blade and adapted to be fitted under said forward lower earth-penetrating edge of said excavator bucket.

3. An attachment according to claim 1 wherein said blade is provided with a plurality of holes for adjusting affixing said brackets to said at a selected one of a plurality of selected widths.

4. An attachment according to claim 1 wherein said blade is formed of upper and lower segments which are at an oblique angle relative to each other, said angle facilitating mounting of said attachment on said bucket.

5. An attachment according to claim 4 wherein said brackets are each formed by an angle iron having a first surface affixed to a rear surface of the upper segment and a second surface provided with said mounting holes.

6. An attachment according to claim 5 wherein said brackets are welded to said blade.

7. An attachment according to claim 5 wherein said brackets are affixed to said blade by means of bolts.

8. In combination, a blade attachment and an excavator bucket assembly having a generally C-shaped wall structure having a first width, with a pair of oppositely disposed sidewalls affixed thereto and having a forward lower edge adapted to penetrate the earth for excavation thereof, said attachment being mounted on said excavator bucket and including an elongated blade having a width substantially greater than said first width;

a pair of mounting brackets affixed to the rear of said blade, at least two mounting holes through each of said mounting brackets aligned with mounting holes provided in said sidewalls, said mounting brackets being spaced apart a distance equal to said first width, and, bolts extending through said aligned holes mounting said brackets directly to said opposite side walls.

9. A combination according to claim 8 wherein said blade has a lower forward earth penetrating edge and includes a rearwardly extending lip affixed to said blade and fitted under said forward lower earth-penetrating edge of said excavator bucket.

10. An attachment according to claim 1 wherein said blade is formed of upper and lower segments which are at an oblique angle relative to each other.

11. An attachment according to claim 8 wherein said brackets are welded to said blade.

12. An attachment according to claim 8 wherein said brackets are affixed to said blade by means of bolts.

* * * * *